US009564080B2

(12) United States Patent
An

(10) Patent No.: US 9,564,080 B2
(45) Date of Patent: Feb. 7, 2017

(54) DISPLAY DEVICE AND OPTICAL DETECTION METHOD THEREOF

(71) Applicant: SAMSUNG DISPLAY CO., LTD., Yongin, Gyeonggi-Do (KR)

(72) Inventor: Byoung-Kwan An, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 185 days.

(21) Appl. No.: 14/504,146

(22) Filed: Oct. 1, 2014

(65) Prior Publication Data

US 2015/0097820 A1 Apr. 9, 2015

(30) Foreign Application Priority Data

Oct. 4, 2013 (KR) ..... 10-2013-0118618

(51) Int. Cl.
*G09G 3/32* (2016.01)

(52) U.S. Cl.
CPC ..... *G09G 3/3208* (2013.01); *G09G 2320/045* (2013.01); *G09G 2360/145* (2013.01)

(58) Field of Classification Search
None
See application file for complete search history.

(56) References Cited

U.S. PATENT DOCUMENTS 5,508,813 A * 4/1996 Sakaegi ..... H04N 9/877 386/300
2004/0095402 A1* 5/2004 Nakano ..... G06F 3/0412 346/102
2005/0087825 A1 4/2005 Cok
2007/0013646 A1* 1/2007 Harada ..... G06F 3/0421 345/102
2009/0046455 A1* 2/2009 Yoshino ..... G02B 6/0068 362/234
2009/0284692 A1 11/2009 Yang et al.
2011/0164010 A1* 7/2011 Yamamoto ..... G09G 3/3233 345/207
2013/0002145 A1 1/2013 Hwang et al.

FOREIGN PATENT DOCUMENTS

KR 10-2006-0107525 A 10/2006
KR 10-2009-0120252 A 11/2009
KR 10-2011-0071386 A 6/2011
KR 10-2013-0002786 A 1/2013

* cited by examiner

*Primary Examiner* — Kent Chang
*Assistant Examiner* — Nathan Brittingham
(74) *Attorney, Agent, or Firm* — Lewis Roca Rothgerber Christie LLP

(57) ABSTRACT

A display device includes a panel assembly including: a display area including a plurality of pixels, and a non-display area at a periphery of the display area; an optical measuring component at the non-display area of the panel assembly and configured to measure light generated from the pixels; and a controller configured to control the panel assembly to sequentially display an emission pattern in which the pixels emit light and a non-emission pattern in which the pixels do not emit light, wherein the controller is configured to calculate a pure emission value by comparing an emission measurement value obtained by measuring the emission pattern through the optical measuring component with a non-emission measurement value obtained by measuring the non-emission pattern through the optical measuring component.

15 Claims, 3 Drawing Sheets

DISPLAY DEVICE AND OPTICAL DETECTION METHOD THEREOF

CROSS-REFERENCE TO RELATED APPLICATION

This application claims priority to and the benefit of Korean Patent Application No. 10-2013-0118618, filed on Oct. 4, 2013, in the Korean Intellectual Property Office, the entire contents of which are incorporated herein by reference in their entirety.

BACKGROUND

1. Field

Aspects of embodiments of the present invention relate to a display device and an optical detection method thereof.

2. Description of the Related Art

Among display devices, an organic light emitting diode (OLED) display (or organic light emitting display) displays images, using organic light emitting diodes that emit light through recombination of electrons and holes. The OLED display has a relatively fast response speed and is driven with relatively low power consumption compared to other display devices. Hence, the OLED display has come into the spotlight as a next-generation display device.

In a panel including organic light emitting diodes, over time, degradation occurs in some pixels, and therefore, display quality may be deteriorated. A method of measuring light generated in a pixel, using an optical measuring portion built in the panel and compensating for a degraded pixel by calculating the degree of decrease in luminance, based on the measured value, is used as the method of compensating for degradation.

Here, the optical measuring portion may be located in a non-display area at the periphery of the panel in order to exclude or reduce the influence of external light. A portion of light emitted in a display area may be totally reflected in a substrate made of a glass material, and reaches up to the non-display area at the periphery of the panel or a bezel area. In this case, the optical measuring portion detects the light reaching the periphery of the panel, thereby analyzing emission luminance.

SUMMARY

According to an aspect of embodiments of the present invention, there is provided a display device, including: a panel assembly including: a display area including a plurality of pixels, and a non-display area at a periphery of the display area; an optical measuring component at the non-display area of the panel assembly and configured to measure light generated from the pixels; and a controller configured to control the panel assembly to sequentially display an emission pattern in which the pixels emit light and a non-emission pattern in which the pixels do not emit light, wherein the controller is configured to calculate a pure emission value by comparing an emission measurement value obtained by measuring the emission pattern through the optical measuring component with a non-emission measurement value obtained by measuring the non-emission pattern through the optical measuring component.

The panel assembly may include a first substrate on which the plurality of pixels are formed, and a second substrate positioned on the first substrate, and the second substrate may cover the first substrate.

The optical measuring component may be at a side surface of the second substrate or between the first and second substrates.

The second substrate may be an encapsulation substrate or a window substrate.

The controller may be configured to calculate the pure emission value by subtracting the non-emission measurement value from the emission measurement value.

The emission measurement value, the non-emission measurement value, and the pure emission value may each include a digitized luminance data.

The emission pattern may be a white image, and the non-emission pattern may be a black image.

The optical measuring component may include a photo sensor.

Each pixel may include an organic light emitting diode.

The optical measuring component may include a plurality of optical measuring components along a periphery of the panel assembly.

The display device may further include a diffused reflection component at the non-display area of the panel assembly and configured to diffusively reflect light generated from the display area.

The optical measuring component may be opposite to the diffused reflection component.

The optical measuring component may be on a bottom surface of the panel assembly.

The display device may further include a light shielding component on the diffused reflection component at the non-display area of the panel assembly.

According to an aspect of embodiments of the present invention, there is provided an optical detection method of a display device, the display device including: a panel assembly including a display area including a plurality of pixels, a non-display area at a periphery of the display area, and an optical measuring component at the non-display area of the panel assembly and configured to measure light, the optical detection method including: displaying an emission pattern in which the pixels emit light; obtaining an emission measurement value by measuring the emission pattern through the optical measuring component; displaying a non-emission pattern in which the pixels do not emit light; obtaining a non-emission measurement value by measuring the non-emission pattern through the optical measuring component; and calculating a pure emission value by comparing the emission measurement value with the non-emission measurement value.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Hereinafter, certain example embodiments according to the present invention will be described with reference to the accompanying drawings.

Figure 1:
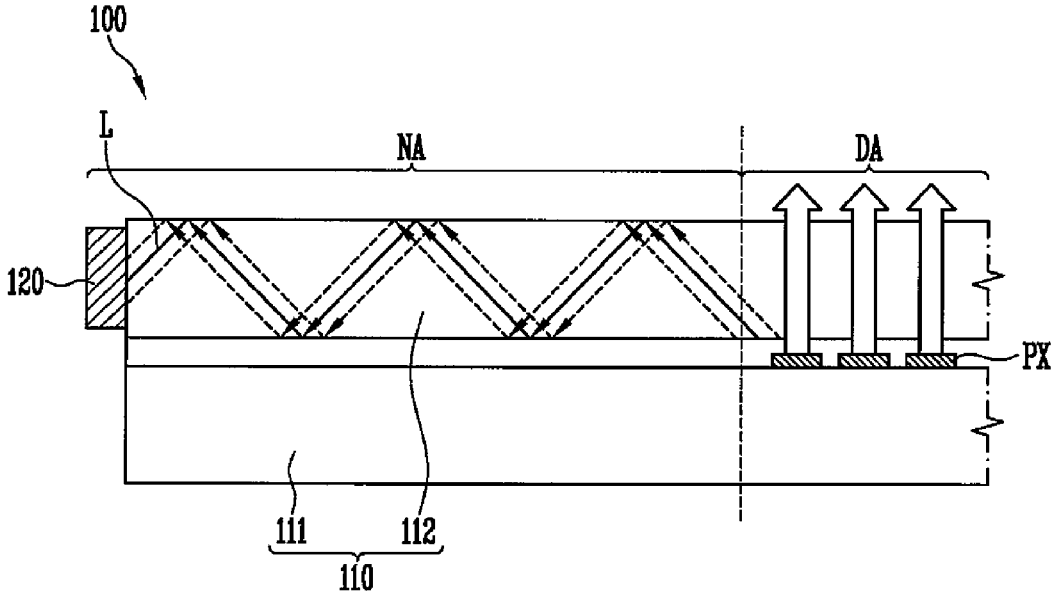
FIG. 1 is a partial sectional view of a display device according to embodiments of the present invention.
Figure 2:
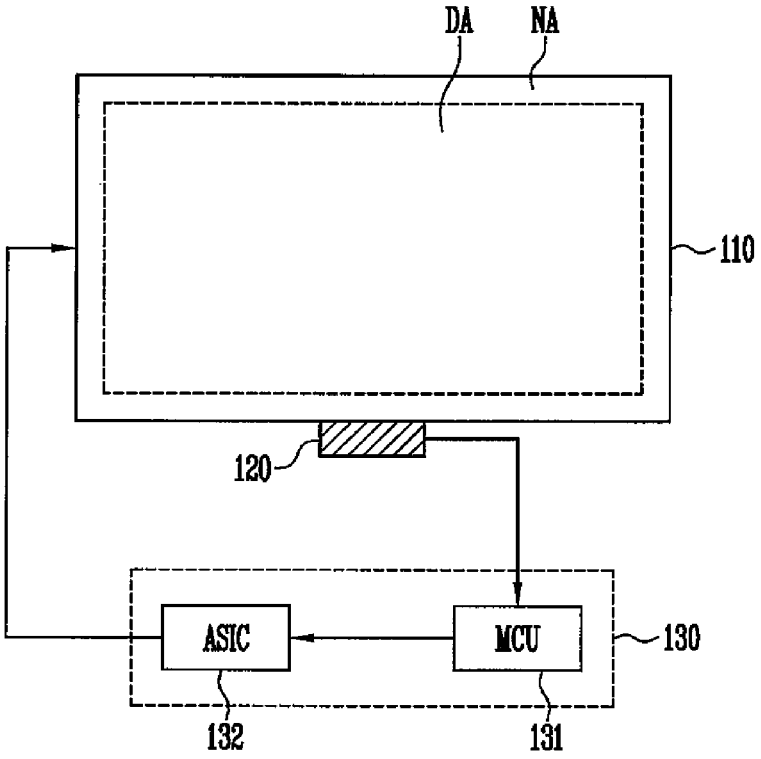
FIG. 2 is a plan view of the display device of FIG. 1.

FIG. 1 is a partial sectional view of a display device according to a first embodiment of the present invention. FIG. 2 is a plan view of the display device of FIG. 1.

In this embodiment, an organic light emitting display has been illustrated as an example of the display device. However, the present invention is not limited thereto. That is, the display device may be replaced with various flat panel display devices. The various flat panel display devices may include a liquid crystal display (LCD), a plasma display panel (PDP), a field emission display (FED), and the like. These displays commonly use, as an essential component, a panel assembly for implementing an image. Hence, the panel assembly has a structure in which a pair of transparent insulating substrates are bonded opposite to each other with an intrinsic emitting or polarizing material layer interposed therebetween.

Referring to FIGS. 1 and 2, the display device 100 includes a panel assembly 110, an optical measuring portion (or optical measuring component) 120, and a controller 130.

The panel assembly 110 includes a plurality of pixels PX for displaying an image. The panel assembly 110 is divided into a display area DA in which the pixels PX are formed, and a non-display area NA at the periphery of the display area DA.

The panel assembly 110 may include a first substrate 111 and a second substrate 112. The pixels PX may be formed on the first substrate 111, and the second substrate 112 may be formed to hermetically seal the pixels PX. Here, the second substrate 112 may be an encapsulation substrate or a window substrate.

Each pixel PX may include an organic light emitting diode. The organic light emitting diode may be patterned on the first substrate 111. Although not shown in these figures, scan and data drivers for driving the pixels PX may be positioned in the panel assembly 110. The panel assembly 110 may include pad electrodes (not shown) for providing an electrical signal to the scan and data drivers.

The optical measuring portion 120 is positioned in the non-display area NA of the panel assembly 110 to measure light generated from the pixels PX. The optical measuring portion 120 may generate a luminance data corresponding to the amount of the measured light.

The optical measuring portion 120 may be positioned closely (e.g., adjacent or directly adjacent) to a side surface of the panel assembly 110. Alternatively, the optical measuring portion 120 may be positioned to be spaced apart from the side surface of the panel assembly 110 at a distance (e.g., a predetermined distance). Here, the optical measuring portion 120 adhered closely to the side surface of the panel assembly 110 may be configured to measure (e.g., exactly measure) the luminance of light L generated in the pixel of the panel assembly 110. The optical measuring portion 120 may include a photo sensor.

In another embodiment, the optical measuring unit 120 may include a plurality of optical measuring portions positioned along the periphery of the panel assembly 110. The plurality of optical measuring portions 120 may be positioned at a regular interval (e.g., a predetermined interval) along the periphery of the panel assembly 110. Alternatively, the plurality of optical measuring portions 120 may be positioned at irregular intervals along the periphery of the panel assembly 110. However, the plurality of optical measuring portions 12 positioned at the interval may be configured to measure (e.g., exactly measure) the luminance of light L generated in the pixel of the panel assembly 110.

The controller 130 controls the panel assembly 110 to sequentially display an emission pattern in which the pixels PX emit light and a non-emission pattern in which the pixels PX do not emit light. The emission pattern may be a white image having a luminance (e.g., a predetermined luminance), and the non-emission pattern may be a black image in the non-emission state of the pixels PX. Here, the emission pattern may include a plurality of images different from one another. Emission pattern information for displaying the emission pattern may include a specific color data and a luminance data, and non-emission pattern information for displaying the non-emission pattern is substantially a power-off data where the power of the pixels PX is off, and has a luminance data of 0. The emission pattern information and the non-emission pattern information may be previously stored in a memory (e.g., a predetermined memory).

The controller 130 calculates a pure emission value by comparing an emission measurement value obtained by measuring the emission pattern with a non-emission measurement value obtained by measuring the non-emission pattern. Specifically, the controller 130 receives an emission measurement value provided from the optical measuring portion 120 in a state in which the emission pattern is displayed at the center of the panel assembly 110 or the entire panel assembly 110. Next, the controller 130 receives a non-emission measurement value provided from the optical measuring portion 120 in a state in which the non-display pattern is displayed. Then, the controller 130 calculates a pure emission value by subtracting the non-emission measurement value from the emission measurement value.

Here, the emission measurement value is a value obtained by measuring together internal light emitted in the pixels PX and external light incident through the second substrate 112 from the outside of the panel assembly 110, and the non-emission measurement value is a value obtained by purely measuring only the external light in a state in which the internal light does not exist or is not generated by the panel assembly 110. Thus, if the non-emission measurement value is subtracted from the emission measurement value, it is possible to obtain internal light emitted in the pixels PX (i.e., to calculate a pure emission value).

The emission measurement value, the non-emission measurement value, and the pure emission value may each include a digitized luminance data. However, the luminance data may not be the actual luminance from the panel assembly 110. Because the optical measuring portion 120 is located in the non-display area NA of the panel assembly 110, spaced apart from the pixels PX at a distance (e.g., a predetermined distance), light loss may occur in the process of performing total reflection. Thus, the controller 130 can perform a compensation operation for calculating a more exact or accurate actual luminance by multiplying a rate (e.g., a predetermined rate) with respect to the emission measurement value and the non-emission measurement value, provided from the optical measuring portion 120. After the compensation operation is performed, an operation of calculating the pure emission value may be performed.

In another embodiment, when the optical measuring portion 120 is provided with a plurality of optical measuring portions, the controller 130 may calculate a mean value of the measurement values.

For example, the controller 130 may include a micro control unit (MCU) 131 and an application specific integrated circuit (ASIC) 132. The MCU 131 transmits the emission pattern information and the non-emission pattern information to the ASIC 132. The ASIC 132 controls the panel assembly 110 to sequentially display the emission pattern and the non-emission pattern. The MCU 131 obtains a pure emission value by calculating the emission measurement value and the non-emission measurement value, provided from the optical measuring portion 120. Here, the controller 130 may not necessarily include the MCU 131 and the ASIC 132. For example other suitable programmable devices or integrated circuits may be used instead of the MCU 131 and/or the ASIC 132.

Figure 3A:
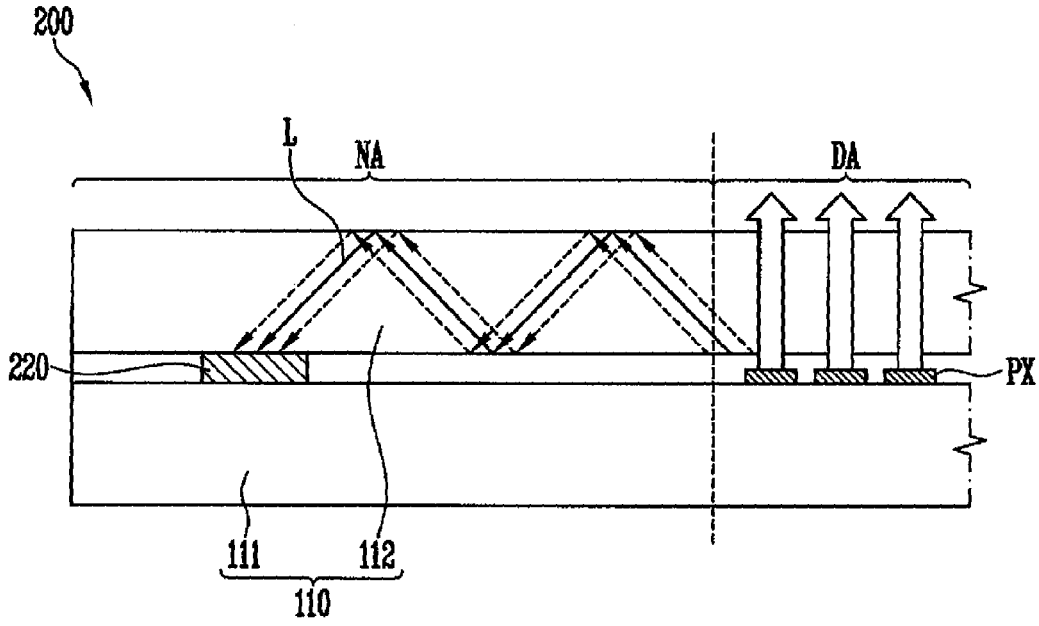
FIGS. 3A and 3B are partial sectional views of display devices according to embodiments of the present invention.
Figure 3B:
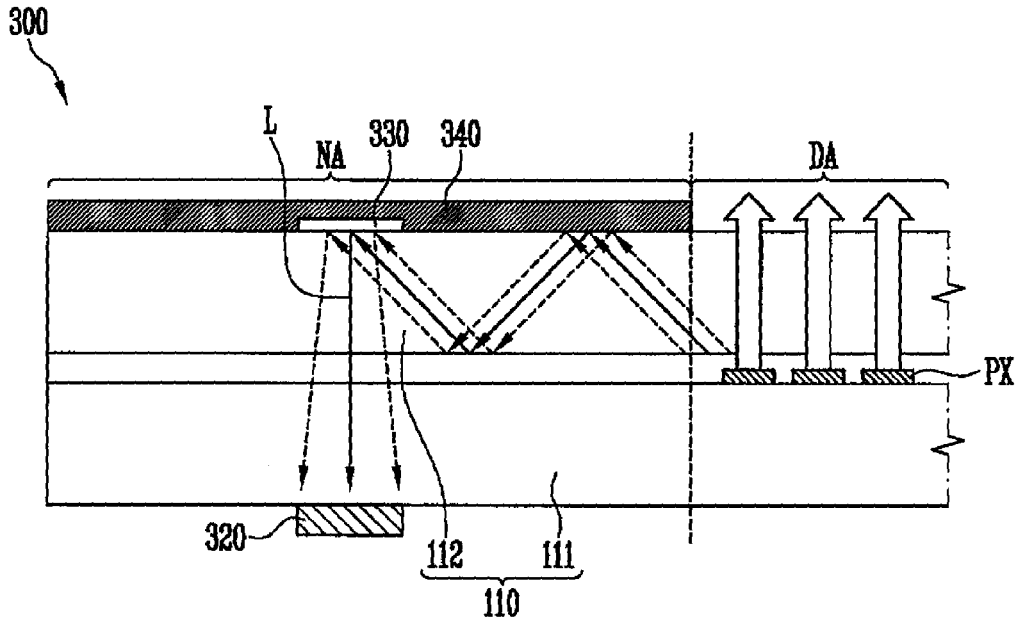

FIGS. 3A and 3B are partial sectional views of display devices according to second and third embodiments of the present invention.

Here, components identical to those of the aforementioned embodiment are designated by like reference numerals, and their detailed descriptions will be omitted to avoid redundancy.

Referring to FIG. 3A, an optical measuring portion 220 of the display 220 according to the second embodiment is located between the first and second substrates 111 and 112. Specifically, the optical measuring portion 220 may be formed on a top surface of the first substrate 111, or may be formed on a bottom surface of the second substrate 112.

Referring to FIG. 3B, an optical measuring portion 320 of the display device 300 according to the third embodiment is positioned on a bottom surface of the panel assembly 110, and may further include a diffused reflection portion (or diffused reflection component) 330 and a light shielding portion 340. The diffused reflection portion 330 and the light shielding portion 340 may be selectively included in the first and second embodiments.

The diffused reflection portion 330 is formed in the non-display area NA of the panel assembly 110 to diffusively reflect light L generated from the display area DA. The diffused reflection portion 330 may be formed at an upper portion in the non-display area NA of the panel assembly 110. Accordingly, the diffused reflection portion 330 may diffusively reflect the light L downward through the panel assembly 110 toward the optical measuring portion 320. The light L diffusively reflected by the diffused reflection portion 330 is incident onto the optical measuring portion 320.

The optical measuring portion 320 may be positioned on the bottom surface of the first substrate 111 to face the diffused reflection portion 330. That is, the optical measuring portion 320 and the diffused reflection portion 330 may be positioned opposite to each other in a vertical direction, based on the panel assembly 110. Through such a structure, most of the light L diffusively reflected by the diffused reflection portion 330 may be reflected to the optical measuring portion 320, thereby more accurately measuring luminance.

The light shielding portion 340 is formed on the diffused reflection portion 330. The light shielding portion 340 is formed in the non-display area NA of the panel assembly 110. The light shielding portion 340 shields external light. Thus, the light shielding portion 340 can minimize the light L diffusively reflected by the diffused reflection portion 330 and again reflected to the display area DA.

Figure 4:
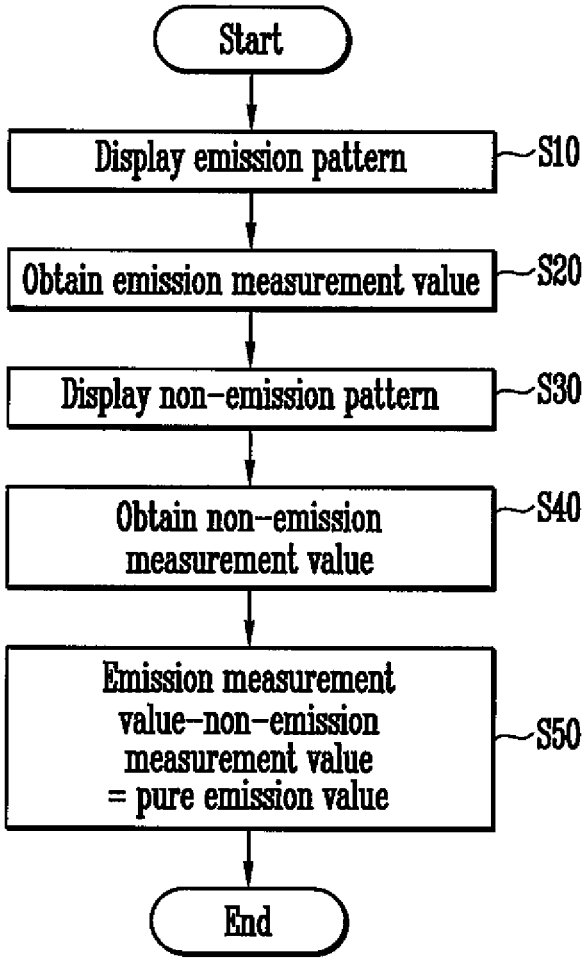
FIG. 4 is a flowchart illustrating an optical detection method of a display device according to embodiments of the present invention.

FIG. 4 is a flowchart illustrating an optical detection method of a display device according to an embodiment of the present invention.

Referring to FIG. 4, first, the panel assembly 110 displays an emission pattern in which the pixels PX emit light (S10). Specifically, the controller 130 controls the panel assembly 110 to display the emission pattern. Here, the emission pattern may be a white image having a luminance (e.g. a predetermined luminance).

Next, the controller 130 obtains an emission measurement value obtained by measuring the emission pattern through the optical measuring portion 120 (S20). That is, the controller 130 receives an emission measurement value provided from the optical measuring portion 120 in a state in which the emission pattern is displayed at the center of the panel assembly 110 or the entire panel assembly 110.

Here, the measurement value may be obtained by positioning the optical measuring portion 120 at a side surface of the panel assembly 110 in the display device 100 shown in FIG. 1, positioning the optical measuring portion 220 inside the panel assembly 110 in the display device 200 shown in FIG. 3A, or positioning the optical measuring portion 320 on a bottom surface of the panel assembly 110 in the display device 300 shown in FIG. 3B.

Next, the panel assembly 110 displays a non-emission pattern in which the pixels PX do not emit light (S30). Specifically, the controller 130 obtains the emission measurement value and then controls the panel assembly 110 to display the non-emission pattern. Here, the non-emission pattern may be a black image in the non-emission state of the pixels PX.

Next, the controller 130 obtains a non-emission measurement value obtained by measuring the non-emission pattern through the optical measuring portion 120 (S40). That is, the controller 130 receives a non-emission measurement value provided from the optical measuring portion 120 in a state in which the non-display pattern is displayed.

Next, the controller 130 calculates a pure emission value by comparing the emission measurement value with the non-emission measurement value (S50). Specifically, the controller 130 calculates the pure emission value by subtracting the non-emission measurement value from the emission measurement value. Here, the emission measurement value is a value obtained by measuring together internal light emitted in the pixels PX and external light incident through the second substrate 112 from the outside of the panel assembly 110, and the non-emission measurement value is a value obtained by purely measuring only the external light in a state in which the internal light does not exist. Thus, if the non-emission measurement value is subtracted from the emission measurement value, it is possible to obtain internal light emitted in the pixels PX, i.e., to calculate a pure emission value.

By way of summation and review, when light is measured, it is possible to measure not only internal light emitted in pixels but also external light incident through a substrate from the outside. According to embodiments of the present invention, a pure emission value is calculated by comparing an emission measurement value obtained by measuring an emission pattern with a non-emission measurement value obtained by measuring a non-emission pattern, so that it is possible to more exactly or accurately measure the amount of light emitted in the panel while excluding or reducing the influence of external light.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A display device, comprising:

a panel assembly comprising:

a display area comprising a plurality of pixels, and a non-display area at a periphery of the display area;

an optical measuring component at the non-display area of the panel assembly and configured to measure light generated from the pixels; and a controller configured to control the panel assembly to sequentially display an emission pattern in which the pixels emit light and a non-emission pattern in which the pixels do not emit light, wherein the controller is configured to calculate a pure emission value by comparing an emission measurement value obtained by measuring the emission pattern through the optical measuring component with a non-emission measurement value obtained by measuring the non-emission pattern through the optical measuring component.

2. The display device of claim 1, wherein the panel assembly comprises a first substrate on which the plurality of pixels are formed, and a second substrate positioned on the first substrate, wherein the second substrate covers the first substrate.

3. The display device of claim 2, wherein the optical measuring component is at a side surface of the second substrate or between the first and second substrates.

4. The display device of claim 2, wherein the second substrate is an encapsulation substrate or a window substrate.

5. The display device of claim 1, wherein the controller is configured to calculate the pure emission value by subtracting the non-emission measurement value from the emission measurement value.

6. The display device of claim 1, wherein the emission measurement value, the non-emission measurement value, and the pure emission value each comprise a digitized luminance data.

7. The display device of claim 1, wherein the emission pattern is a white image, and the non-emission pattern is a black image.

8. The display device of claim 1, wherein the optical measuring component comprises a photo sensor.

9. The display device of claim 1, wherein each pixel comprises an organic light emitting diode.

10. The display device of claim 1, wherein the optical measuring component comprises a plurality of optical measuring components along a periphery of the panel assembly.

11. The display device of claim 1, further comprising a diffused reflection component at the non-display area of the panel assembly and configured to diffusively reflect light generated from the display area.

12. The display device of claim 11, wherein the optical measuring component is opposite to the diffused reflection component.

13. The display device of claim 12, wherein the optical measuring component is on a bottom surface of the panel assembly.

14. The display device of claim 11, further comprising a light shielding component on the diffused reflection component at the non-display area of the panel assembly.

15. An optical detection method of a display device, the display device comprising:

a panel assembly comprising a display area comprising a plurality of pixels, a non-display area at a periphery of the display area, and an optical measuring component at the non-display area of the panel assembly and configured to measure light, the optical detection method comprising:

displaying an emission pattern in which the pixels emit light;

obtaining an emission measurement value by measuring the emission pattern through the optical measuring component;

displaying a non-emission pattern in which the pixels do not emit light;

obtaining a non-emission measurement value by measuring the non-emission pattern through the optical measuring component; and calculating a pure emission value by comparing the emission measurement value with the non-emission measurement value.

* * * * *